United States Patent [19]

Gray

[11] 4,451,941

[45] Jun. 5, 1984

[54] TOILET BOWL SANITIZER DISPENSER

[75] Inventor: James R. Gray, Little Rock, Ark.

[73] Assignee: Sterling Drug, Inc., New York, N.Y.

[21] Appl. No.: 486,238

[22] Filed: Apr. 18, 1983

[51] Int. Cl.[3] ..... E03D 9/02

[52] U.S. Cl. ..... 4/228; 4/227; 134/36

[58] Field of Search ..... 4/222, 227, 228; 134/36; 222/185, 57, 478, 481, 482, 424.5

[56] References Cited

U.S. PATENT DOCUMENTS

| | | | |
|---|---|---|---|
| 3,339,801 | 9/1967 | Hronas | 222/57 |
| 3,504,384 | 4/1970 | Radley et al. | 4/228 |
| 4,171,546 | 10/1979 | Dirksing | 4/228 |
| 4,186,856 | 2/1980 | Dirksing | 4/228 |
| 4,208,747 | 6/1980 | Dirksing | 4/228 |
| 4,216,027 | 8/1980 | Wages | 134/36 |
| 4,251,012 | 2/1981 | Owens et al. | 222/185 |
| 4,305,162 | 12/1981 | Cornelisse et al. | 4/228 |
| 4,375,109 | 3/1983 | Jones | 4/228 |

*Primary Examiner*—Henry K. Artis

[57] ABSTRACT

A sanitizer dosing dispenser for immersion in a body of water such as a toilet tank whose water line can be lowered from an upper level to a lower level by flushing, which includes a product chamber for containing a solid, water soluble material, first and second walls defining a first flow path therebetween for providing a predetermined volume of water from the body of water to the product chamber along the first flow path in response to the level of the body of water falling from the upper level to the lower level. The first wall is flexible and located so that hydrostatic pressure from the body of water presses the first wall against the second wall to close the first flow path against water flow therealong when the level of the body of water is above the first wall, and permits the predetermined volume of water to flow into the product chamber to dissolve a portion of the soluble material therein when the level of the body of water is below the first wall. The dispenser also includes structure for dispensing substantially the same predetermined volume of solution from the product chamber along a second flow path into the body of water when the body of water falls from the upper level to the lower level. The dispenser includes a water chamber in fluid communication with the exterior of the dispenser for holding the predetermined volume of water above the first flow path when the body of water is at the upper level. When the first flow path opens, the predetermined volume of water falls therealong by gravity into the product chamber.

53 Claims, 21 Drawing Figures

TOILET BOWL SANITIZER DISPENSER

FIELD OF THE INVENTION

The present invention relates to a sanitizer dosing dispenser for use in dispensing products such as toilet tank cleaner additives, and more particularly to such a dispenser which can be fastened to a sidewall of a toilet tank and automatically dispenses a predetermined volume of additive containing solution to the tank water each time the toilet is flushed. The dispenser is of the type which contains one or more tablet chambers normally isolated from the body of water in the tank and in which the additive or additives are stored in solid water soluble form. A quantity of tank water is caused to enter each chamber and each time the toilet is flushed dissolves a portion of the additive therein to form an additive solution, a predetermined volume of which is automatically dispensed each time the toilet is flushed.

BACKGROUND OF THE INVENTION

Additives, typically sanitizing chemicals, suitable for use in automatic toilet bowl cleaner dispensers can be broadly classified as those containing detergents (or surfactants) and those containing oxidants. When automatically dosed into a toilet tank and/or bowl, a detergent reduces the surface tension of the water and concentrates on any oil-water interface to exert an emulsifying action which aids in the removal of stains and soils from the toilet bowl surface. Signal dyes, chelating agents, fragrance oils and other beneficial materials can generally be mixed directly with the detergent.

Cleaners containing an oxidant, on the other hand, provide a strong oxidizing action which bleaches stains, breaks down soils and serves as a disinfectant by killing microorganisms such as bacteria. Materials commonly used to create the oxidizing action are those which produce available chlorine via hypochlorite ions, such as calcium hypochlorite. Signal dyes, surfactants, and other beneficial materials generally cannot be mixed directly with the oxidants.

Although the chemical actions of detergents and oxidants are very different, they both can produce useful toilet cleaning action and, in fact, produce particularly good cleaning when used together, provided that they are sufficiently separated from each other prior to dispensal to the toilet water. Sanitizer dispensers which accomplish this separate dispensing of a detergent and a disinfectant such as an oxidant are disclosed in U.S. Pat. No. 3,504,384 issued to Radley et al. on Apr. 7, 1970 and U.S. Pat. No. 4,216,027, issued to Wages on Aug. 5, 1980.

The current trend in new single cleaner automatic toilet bowl cleaner products is the use of oxidants because small quantities of the oxidants such as calcium hypochlorite can maintain an effective 5 to 10 ppm concentration of available chlorine in the toilet water over a 4-month product life. This product life substantially exceeds the practical limits of about 30 days for detergent type automatic toilet bowl cleaner products.

Such oxidant disinfectant containing products are ordinarily provided in a soluble solid form within a chamber of the dispenser, to be dissolved by a volume of tank water. Each time the toilet is flushed, a predetermined volume of tank water enters the dispenser and a substantially equal volume of solution issues from the dispenser into the tank water. During quiescent periods between flushes, it is desirable to isolate the oxidant solid and oxidant containing solution from the tank water. Dispensers of oxidant disinfectants to toilet water which contain soluble solid oxidant products which operate in this manner are disclosed in the above-mentioned Wages patent, U.S. Pat. Nos. 4,171,546, 4,186,856, and 4,208,747, respectively issued to Dirksing on Oct. 23, 1979, Feb. 5, 1980, and June 24, 1980; U.S. Pat. No. 4,305,162, issued to Cornelisse, Jr. et al. on Dec. 15, 1981, and U.S. Pat. No. 4,307,474, issued to Choy on Dec. 29, 1981.

All of the dispensers disclosed in these patents are completely passive, that is, they have no moving parts, rely upon suction or vacuum transfer for dispensing the solution, and rely entirely upon the formation of air locks in water inlets and solution outlets in order to maintain isolation between the solid and solution in the dispenser, and the tank water, during quiescent periods between flushes of the toilet. The air locks require a balance of hydrostatic pressure between the solution in the dispenser and the surrounding water in the tank. Consequently, when the toilet is flushed and the water level in the tank recedes below the air locks solution in the dispenser, the resulting imbalance in hydrostatic pressure caused the solution to immediately begin to flow into and through the outlet into the tank water.

It is an object of the present invention to provide a simple and inexpensively produced toilet-bowl cleaner dispenser in which a water soluble solid cleaner is stored in a chamber during quiescent periods between flushes isolated from the toilet tank water by at least one positively closing valve and from which a predetermined volume of cleaner containing solution is dispensed without suction each time the toilet is flushed.

SUMMARY OF THE INVENTION

In accordance with one aspect of the invention there is provided a sanitizer dosing dispenser for immersion in a body of water such as in a toilet tank whose water line or level can be lowered from an upper level to a lower level as by flushing, which includes a product chamber or internal reservoir for containing a solid, water soluble material, first and second walls defining a first flow path therebetween for providing a predetermined volume of water from the body of water to the product chamber along the first flow path in response to the level of the body of water in which the dosing dispenser is immersed falling from the upper level to the lower level. The first wall is flexible and located so that hydrostatic pressure from the body of water presses the first wall against the second wall to close the first flow path against the water flow therealong when the level of the body of water is above the first wall, and permits the predetermined volume of water to flow between the first and second walls into the product chamber when the level of the body of water is below the first wall, water in the product chamber dissolving a portion of the material therein to form a material containing solution. The dispenser also includes structure for dispensing substantially the same predetermined volume of the solution from the product chamber into the body of water when the body of water falls from the upper level to the lower level.

In accordance with another aspect of the invention, the dosing dispenser is provided with a water chamber in fluid communication with the exterior of the dispenser for holding a predetermined volume of water above the first flow path when the body of water is at the upper level, the predetermined volume of water falling by gravity along the first flow path into the product chamber from the water chamber when the level of the body of water falls below the first wall.

In accordance with the different preferred embodiments of the invention, the space within the product chamber not occupied by the soluble solid material may be completely filled with or empty of solution during the quiescent periods between flushes.

In accordance with one embodiment of the invention in which the product chamber is always filled with solution, a conduit directly communicating with the uppermost end of the product chamber is provided, whereby entry of the predetermined volume of water into the product chamber via the first flow path displaces an equal volume of solution into the body of water through the conduit, an air bubble in the conduit isolating the solution in the product chamber from the body of water during quiescent periods between flushes.

In accordance with another preferred embodiment of the invention in which the product chamber is empty of solution during the quiescent periods between flushes, third and fourth walls below the product chamber define a second flow path therebetween from the product chamber to the body of water. The third wall is flexible and located so that hydrostatic pressure applied by the body of water presses the third wall against the fourth wall to close the second flow path against water flow therealong when the level of the body of water is above the third wall, and permits the volume of solution to flow by gravity from said product chamber between the third and fourth walls to the exterior of the dispenser into the body of water when the level of the body of water falls below the third wall, thereby emptying the product chamber of solution.

BRIEF DESCRIPTION OF THE DRAWING

These and other aspects of the invention will be better understood from the following description of preferred embodiments in conjunction with the accompanying drawings in which:

FIG. 1(*b*) is a sectional perspective view of the embodiment illustrated in FIG. 1(*a*);

FIG. 1(*c*) is a partial fragmentary elevation view of an alternative water chamber in accordance with the present invention;

FIG. 6(*b*) is a side elevational view of the embodiment illustrated in FIG. 6 (*a*);

FIG. 6(*c*) is a rear elevational view of the rigid molded portion of the embodiment of the invention illustrated in FIG. 6 (*a*);

FIG. 6(*d*) is a side sectional view taken along lines 6(*d*)—6(*d*) in FIG. 6(*c*);

FIG. 11(*a*) is a partially torn away rear elevational view of a seventh embodiment of the sanitizer dosing dispenser in accordance with the present invention;

FIG. 11(*b*) is a fragmentary side elevational view of the holder in accordance with the embodiment illustrated in FIG. 11(*a*);

FIG. 11(*c*) is a fragmentary side elevational view of the lower portion of the embodiment illustrated in FIG. 11(*a*);

In the drawings identical numerals in different figures designate corresponding or identical elements.

DETAILED DESCRIPTION OF THE PREFERRED EMBODIMENTS

Figure 1C:
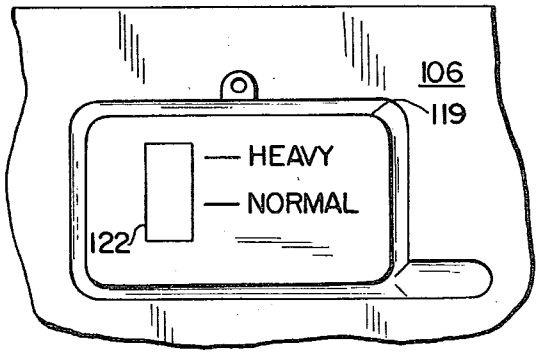
FIG. 1(*a*) is a perspective view of a preferred embodiment of the sanitizer dosing dispenser of the present invention.
Figure 1A:
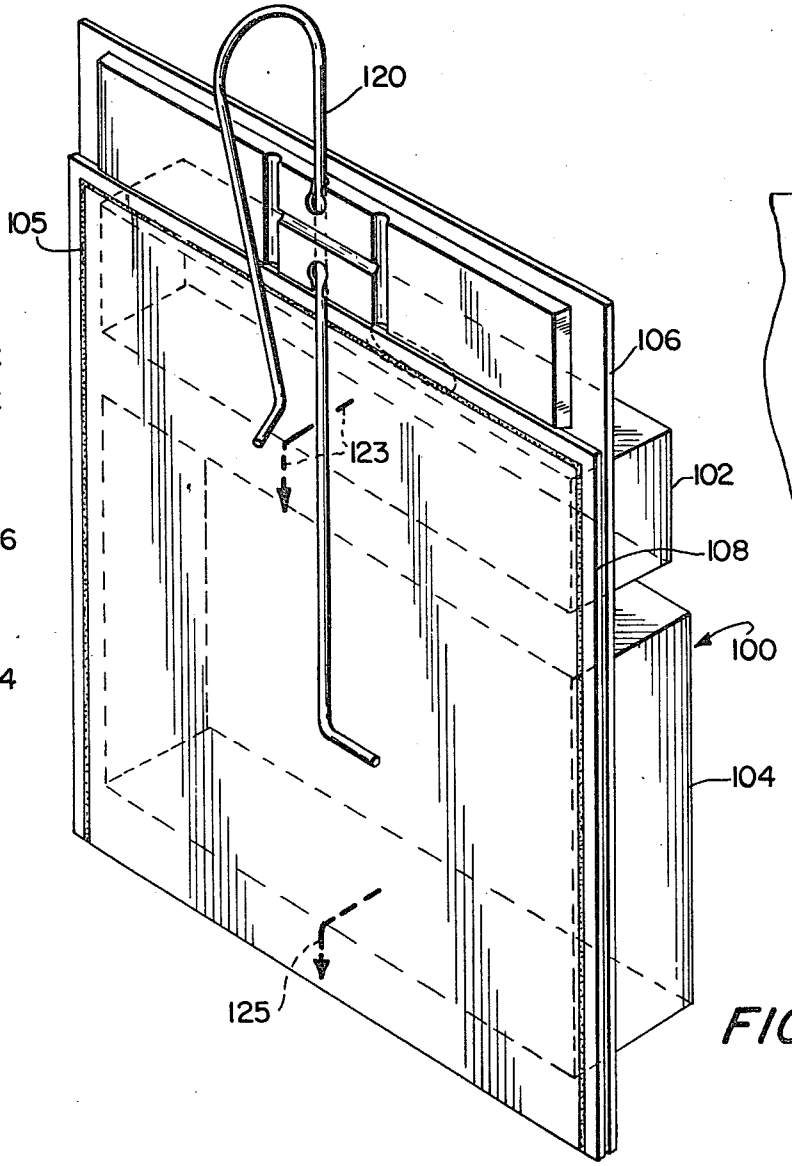
Figure 1B:
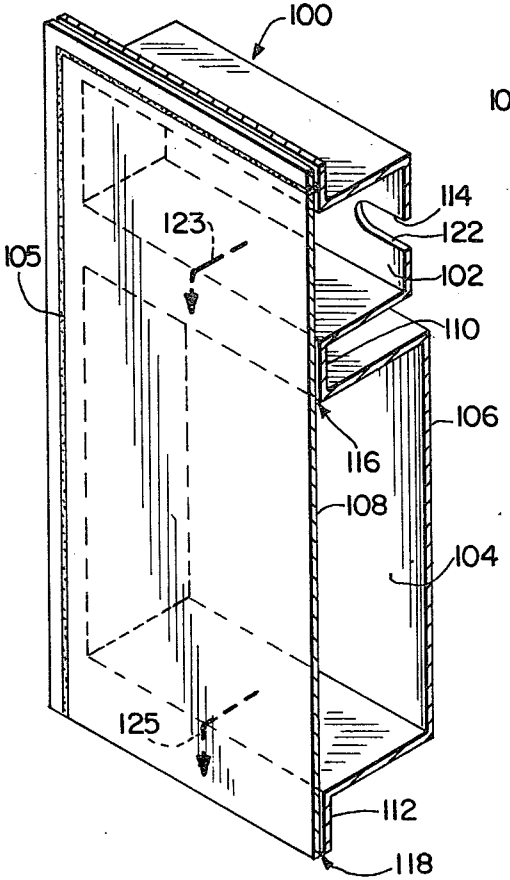

Referring to FIGS. 1(*a*) and 1(*b*), there is shown a first embodiment 100 of a sanitizer dosing dispenser which may be utilized to provide a precise dose of either an oxidant sanitizer or a detergent sanitizer to the toilet tank water only when the toilet is flushed. As with all of the preferred embodiments of the invention described herein below, the dispenser 100 completely isolates the oxidant sanitizer or detergent sanitizer from the toilet tank water between flushes. This operation protects the concentrated oxidizing agent from degradation between flushes, and at the same time protects the toilet fixture and provides product longevity by emitting an oxidant level only high enough for effective cleaning action. Similarly, when a detergent sanitizer is used, a highly concentrated detergent mixture is permitted to be dissolved under controlled conditions and metered into the tank water with each flush, thus producing suitable product longevity using a small enough quantity of detergent material to be economically packaged.

Dispenser 100 is formed with a tank water trap chamber 102 and a sanitizing product chamber or internal reservoir 104, from integral walls 106 formed from a relatively rigid material such as polyvinyl chloride, and a flexible sheet 108 suitably heat sealed over the compartments 102 and 104 along seal lines 105, and lying flat against, but not sealed to, the vertical wall portions 110 and 112 respectively formed below chambers 102 and 104. A block of water soluble sanitizer material (not shown in FIGS. 1(*a*) and 1(*b*)) is provided in product chamber 104.

An orifice 114 is provided in tank water trap chamber 102 so that when the dispenser is inserted in the toilet tank with orifice 114 below the level of the body of water in the tank, water will flow into chamber 102 at least to the bottom edge 122 of the orifice 114. As will be described below, the confronting portions of the flexible sheet 108 and vertical wall portions 110 and 112 of the rigid member 106 serve as valves which may be designated by the numerals 116 and 118.

In operation, as the dispenser 100 is first lowered into the toilet tank, the tank water attempts to flow into the sanitizer chamber through valve 118, but is prevented from doing so by hydrostatic pressure of the tank water applied against opposing faces of the flexible and rigid materials of the valve 118, which presses the two materials together to effectively seal the bottom of the chamber 104. As the dispenser 100 is further lowered into the tank water, the water line passes the top of the sanitizing chamber 104. Again, pressure of the tank water is applied against opposing faces of the rigid and flexible materials of the valve 116 to seal the top of chamber 104. As the dispenser 100 is further immersed and the water line reaches orifice 114, tank water is allowed to flow into and fill the water trap chamber 102. A suitable hook 120 or other convenient means such as is shown in FIG. 1(*b*) may be utilized to secure the dispenser 100 to a sidewall of the toilet tank. Convenient securing means are described in more detail below with reference to FIGS. 6(*a*), 6(*b*), 11, 12, and 13.

When the dispenser 100 is submerged with the water line above valve 116, the product chamber 104 is completely sealed with a quantity of tank water trapped in the water chamber 102. In this condition, when the toilet is flushed, the tank water line first moves down past the water chamber orifice 114 and water in the compartment above the bottom edge 122 of orifice 114 is allowed to run out into the tank. Thus, the position of the bottom edge 122 of orifice 114 establishes the precise quantity of water allowed to remain in the water chamber 102 as the level of the tank water continues to fall. It should be noted, however, that by making the water chamber orifice sufficiently small, the amount of water which runs out of the orifice can be severely restricted so that the amount of water remaining in the water chamber is defined by the initial upper level of the water relative to the water chamber, and in this way, such amount of water in the water chamber can be controlled by adjusting the height of the dispenser 100 in the tank. For example, if the dispenser is provided with a water chamber 119 of the design shown in FIG. 1(*c*) having a small vertical orifice 122 instead of water chamber 102, a greater amount of water can be provided to product chamber 104 by mounting the dispenser in the tank with the tank water line at the level marked 'HEAVY' on the front face of water chamber 119. Similarly, a lesser amount will be provided if the dispenser is mounted with the tank water line at the level marked 'NORMAL'.

Referring again to FIGS. 1(*a*) and 1(*b*), as the tank water line falls past valve 116, the hydrostatic pressure applied to valve 116 is removed. As a result, valve 116 opens and allows the predetermined volume of water remaining in water chamber 102 to run into the product chamber 104 as shown in FIG. 1(*a*) along the flow path designated by arrow 123, where it dissolves a small quantity of the sanitizer material to form a substantially equal volume of sanitizer material containing solution. As the tank water line drops past the valve 118 below product chamber 104, hydrostatic pressure applied to the flexible wall 108 at valve 118 is removed and the volume of solution now in product chamber 104 flows through the now open valve 118 into the toilet tank along the flow path designated by arrow 125.

The dispenser 100 is now free of all solution and water as it was prior to insertion in the toilet tank. The above described cycle is repeated each time the toilet water tank alternately fills at the end of the flush cycle and is subsequently flushed again.

Although the dispenser 100 is simply constructed using a flexible sheet to provide one of the walls of each of chambers 102 and 104 and valves 116 and 118, other constructions are also possible. It is only necessary to provide flexibility to at least one of the walls of each of the valves 116 and 118 so that hydrostatic pressure can be utilized to keep the valves closed.

The invention is adaptable to controlling the flow rate of the water and/or sanitizing solution through the valves and out of the structure. For example, by constructing the valves 116 and 118 with appropriate widths, the flow of water and solution can be restricted through these valves so as to regulate the length of time the predetermined volume of water from the water chamber 102 is allowed to dissolve the sanitizer material in the sanitizer compartment 104 before being released through valve 104 to the tank water below.

In addition, the flow rate of solution out of the dispenser can be further regulated by directing the flow through an orifice of proper size. As illustrated in the embodiment of the invention illustrated in FIG. 2, in which elements identical to or corresponding to those illustrated in FIGS. 1(*a*) and 1(*b*) are designated by like numerals, the flexible and rigid wall members 108 and 106 are respectively extended below valve 118 to form a small compartment or dispensing chamber 124 having a discharge orifice 126 and a bottom wall 128 and sealed along peripheral seal lines 127. In operation, the solution from product chamber 104 flows through valve 118 into compartment 124 and dispensed into the toilet tank through discharge orifice 126, the size of discharge orifice 126 controlling the rate of dispensing.

Some soluable sanitizing materials will operate better if blocks of the same are continuously immersed in a quantity of water so that the quantity of water becomes saturated with the sanitizing material and a small volume of the saturated solution is ejected into the toilet tank each time the toilet is flushed. This may be accomplished by modifying either the embodiment of FIGS. 1(*a*) and 1(*b*) or the embodiment of FIG. 2. Such a modification of the embodiment of FIG. 2 is illustrated in FIG. 3.

Figure 3:
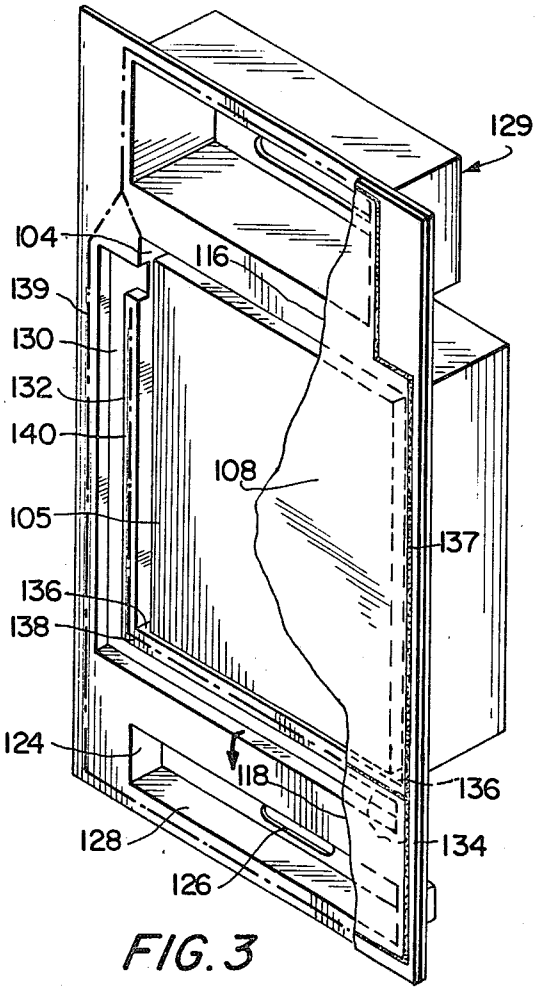
FIG. 3 is a partially torn away perspective view of a third embodiment of the sanitizer dosing dispenser in accordance with the present invention.
Figure 2:
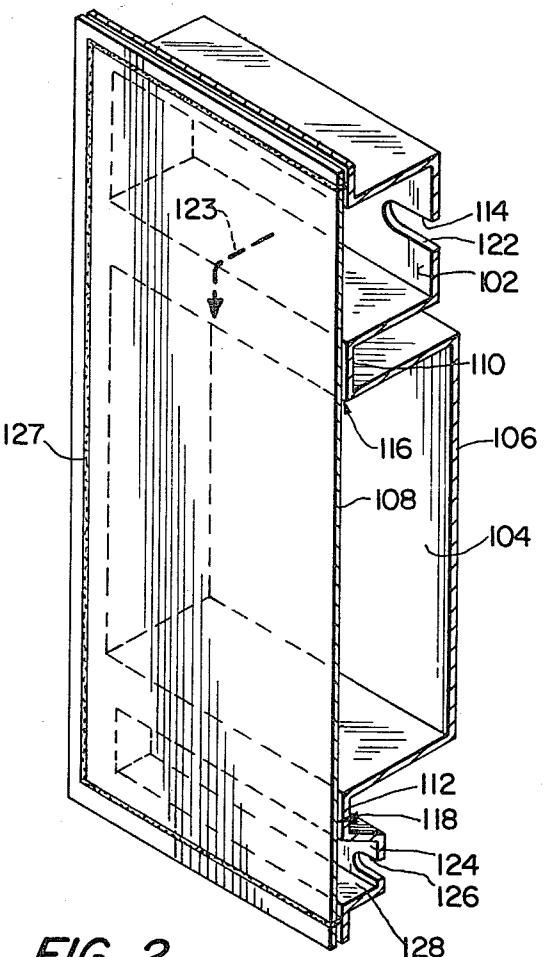
FIG. 2 is a sectional perspective view of a second embodiment of the sanitizer dosing dispenser in accordance with the present invention.
Figure 6B:
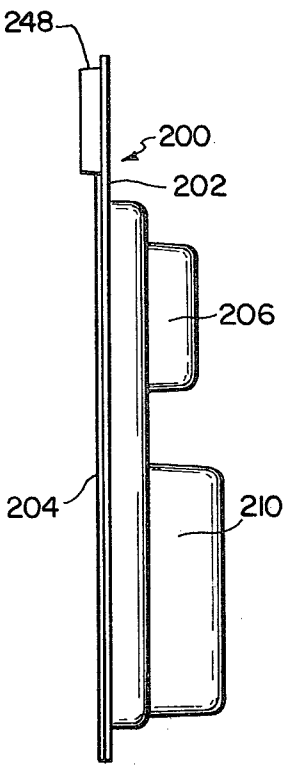
FIG. 6(*a*) is a partially torn away perspective view of a fifth embodiment of the sanitizer dosing dispenser in accordance with the present invention.
Figure 6A:
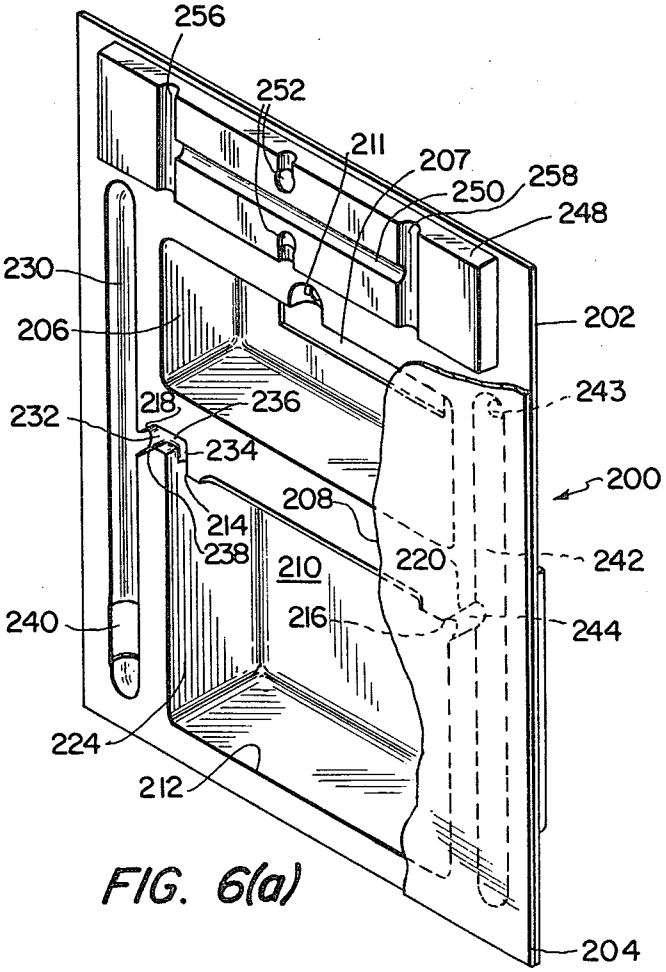

Referring to FIG. 3, the dispenser embodiment 129 illustrated in FIG. 3 is similar to that of FIG. 2 except that product chamber 104, which contains a block of sanitizer material 105, is sealed at its bottom and a vertical conduit 130 opening into the top end of product chamber 104 extends along one vertical side of product chamber 104 separated from product chamber 104 by product chamber sidewall 132. Vertical conduit 130 opens into a horizontal conduit 134 extending below product chamber 104 separated from product chamber 104 by product chamber bottom wall 136. Flexible sheet 108 is sealed along seal line 137 to the outer perimeter edges 139 of the dispenser, to the back edge 138 of bottom wall 136 and to the back edge 140 of sidewall 132 of vertical conduit 130.

In operation, after product chamber 104 has become filled with solution, each time the toilet is flushed and the water level falls below valve 116, the predetermined volume of water in water chamber 102 flows through valve 116 into product chamber 104 displacing an equal volume of solution from product chamber 104 into vertical conduit 130. The solution displaced into conduits 130 and 134 is initially trapped in the conduits since valve 118 is closed by hydrostatic pressure applied thereto by the tank water in the manner described above with respect to the embodiment illustrated in FIGS. 1(*a*) and 2. When the water drops below valve 118, valve 118 opens releasing the solution in conduits 130 and 134 through the valve into compartment 124 for dispensing through discharge orifice 126 in the same manner as described above with respect to the embodiment illustrated in FIG. 2. The water added to the solution in product chamber 104 initially dilutes the solution therein, but over the period of time between flushes, more of the sanitizer material dissolves until the solution becomes saturated.

The present invention may also be constructed using an injection molded container-type structure. For example, a dispenser which operates in substantially the same manner as the embodiment disclosed in FIG. 3 may be formed as illustrated in FIGS. 4 and 5.

Figure 4:
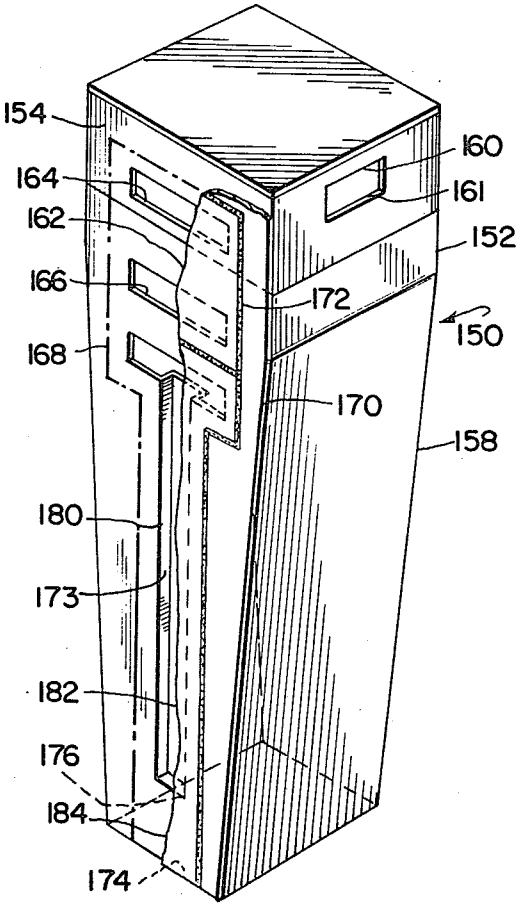
FIG. 4 is a partially torn away perspective view of a fourth embodiment of the sanitizer dosing dispenser of the present invention.
Figure 5:
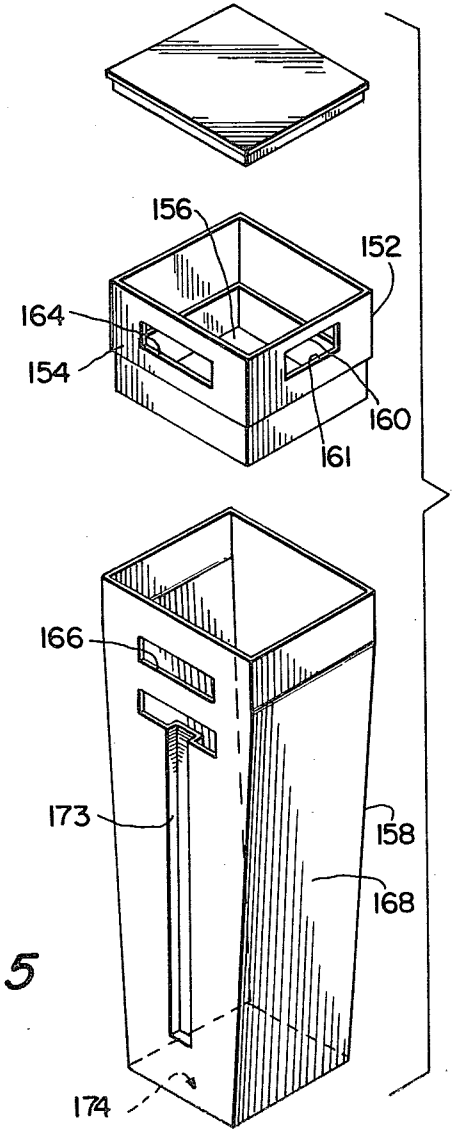
FIG. 5 is a perspective exploded view of the container structure of the embodiment illustrated in FIG. 4.

Referring to FIGS. 4 and 5, sanitizer dosing dispenser 150 includes an injection molded water chamber 152 having sidewalls 154 and a bottom wall 156 which can be ultrasonically sealed to an injection molded product chamber 158 having sidewalls 168 and a bottom wall 174. A block of soluble sanitizer material (not shown in the figures) is contained in product chamber 158. One of the sidewalls 154 of water chamber 152 is provided with an orifice 160 having a bottom edge 161, for receiving water from the toilet tank. A valve 162 between water chamber 152 and product chamber 158 includes an opening 164 in the walls 154 of water chamber 152 below the orifice 160, an opening 166 at the upper end of sidewalls 168 of product chamber 158 vertically aligned with opening 164 in sidewalls 154 of the water chamber 152, and a flexible sheet 170 heat sealed to the upper chamber 152 and lower chamber 150 along seal lines 172 surrounding openings 164 and 166. Sidewalls 168 of product chamber 158 are indented to form a groove 173, preferably vertically aligned with openings 164 and 166 and extending downwardly to a point 176 adjacent to, but spaced from bottom wall 174 of product chamber 158. In order that groove 173 serve as a conduit leading to a discharge valve serving the same function as valve 118 in FIG. 3, the flexible sheet 170 is extended downward over groove 173 to the bottom wall 174 of product chamber 158 and heat sealed along its vertical edges 180 to sidewalls 168 to form a vertical conduit 182 which leads to a valve 184 opening to the exterior of the dispenser 150.

The embodiment illustrated in FIGS. 4 and 5 operates in the following manner. Sanitizer dosing dispenser 150 is mounted to a sidewall of a toilet tank by any convenient means with the bottom edge 161 of orifice 160 below the tank water level. Water in the tank flows into water chamber 152 through orifice 160, but water is unable to enter product chamber 168 since hydrostatic pressure closes valves 162 and 184, respectively sealing the top and bottom ends of the product chamber 168 from water entry. When the toilet is flushed and the level of water in the tank drops below valve 162, valve 162 opens and a predetermined volume of water from water chamber 152 passes through opening 164 between sidewalls 154 and 168 and the confronting portions of flexible wall 170, and into product chamber 158 through opening 166. Water entering product chamber 158 through opening 166 is trapped in product chamber 158 until or unless the product chamber is filled to the top edge of conduit 182. When product chamber 158 is filled with the sanitizer material and a solution of water and dissolved sanitizer material, the predetermined volume of water entering product chamber 158 through opening 166 displaces an equal volume of solution into conduit 182. The solution in conduit 182 remains there until the level of the tank water drops below valve 184. When the toilet tank water level drops below valve 184, valve 184 opens and the solution in conduit 182 flows out into the toilet tank water. As the toilet tank water level again rises, its hydrostatic pressure causes valves 184 and 162 to close in turn. The solution in product chamber 158 remains isolated from the toilet tank water until the next flush.

The embodiment of FIGS. 4 and 5 may be modified to operate in manners similar to those of the embodiments illustrated in FIGS. 1(*a*) and (*b*) and 2 by respectively replacing conduit 180 by an opening just above valve 184 and adding a small metering compartment below valve 184.

One potential problem with some of the embodiments of the invention, particularly those illustrated in FIGS. 1(*a*) and (*b*), and 2, is that it is possible that solid or semisolid pieces of the sanitizer material may break off from the block or tablets in the product chamber and become lodged in the lower valve so as to interfere with the operation of the lower valve. This problem can be overcome or at least limited by supporting the sanitizer material over a sludge chamber into which any pieces of sanitizer material which become dislodged may fall and become trapped. However, the applicant has found that a more effective method of avoiding this problem is to replace the lower valve by an air vent and discharge conduits which transmit doses of solution displaced from the product chamber in a manner similar to that illustrated with reference to the embodiments of the invention illustrated in FIGS. 3, and 4 and 5 of the drawings, and in which an air bubble is formed to isolate the product chamber from the tank water during quiescent periods between flushes of the toilet. Embodiments of the invention following this approach are disclosed in FIGS. 6(*a*)–14.

Referring to FIGS. 6(*a*), 6(*b*), and 6(*c*), there is shown a sanitizer dosing dispenser 200 suitably constructed from a rigid plastic molded member 202, and a flexible plastic sheet member 204 heat sealed to the rear side of the molded member 202 along seal line (not shown in FIGS. 6(*a*) and 6(*b*)) so as to define a water chamber 206 having an inlet orifice 207, a valve 208 and a product chamber 210, respectively similar to water chamber 102, valve 116 and product chamber 104 of the embodiment illustrated in FIGS. 1(*a*) and 1(*b*). An air hole 211 is provided at the top of water chamber 206. Product chamber 210 is sealed closed at its bottom edge 212 and opens at it respective upper left and right corners 214 and 216 to a solution discharge 218 and an air vent 220, respectively. Valve 208 opens to product chamber 210 along a narrow horizontal quarter circular cross sectional air space 222 which is best illustrated in FIG. 6(*d*). The product chamber 210 includes a generally rectangular block-shaped recess 224 for holding the block of sanitizer material (not shown in the Figures).

Discharge 218 includes a vertical conduit 230 and a generally inverted inverted U-shaped conduit 232. The generally inverted U-shaped conduit 232 opens at opposite ends into the vertical conduit 230 and the upper left corner 214 of product chamber 210. The generally inverted U-shaped conduit 232 includes a vertical portion 234, a horizontal portion 236 and an angular portion 238. A discharge orifice 240 is provided near the bottom end of vertical conduit 230.

The air vent 220 includes a vertical conduit 242 having an air hole 243 horizontally aligned with air hole 211, and an angled conduit 244. Angled conduit 244 opens at a bottom end in the upper right corner 216 of product chamber 210 and at a top end into the vertical conduit 242.

It may be noted the upper end of the vertical discharge conduit 230 and the lower end of the vertical air vent conduit 242 are provided for purposes of adding rigidity to the dispenser, and serve no useful function in providing liquid and gaseous communication between the product chamber and the exterior of the dispenser 200.

Above the water chamber 206 and the top edge of flexible sheet member 204, a portion 248 of the rigid molded member 202 is recessed in the opposite directions of the recesses which form the water chamber 206, the product chamber 210, discharge 218 and the air vent 220. Recessed portion 248 has a horizontal rib 250, and a pair of vertically aligned holes 252 on opposite sides of the rib 250. A hook member suitably designed to pass through holes 252, such as is illustrated in FIG. 1(*a*), may be provided in order to hook over the top rim of the toilet tank and thereby fasten the dispenser to the sidewall of the toilet tank. Rib 250 serves to press the hook member against the top and bottom ends of the recess 248 to tightly hold the dispenser 200 thereto. In order to provide sufficient rigidity to the horizontal rib member 250, it may be terminated at a suitable length by vertical ribs 256 and 258. Alternatively, the width of recess 248 may be shortened to coincide with the ends of rib 250.

In operation, the dispenser 200 should be fastened to the sidewall of the toilet tank so that the water level in the tank is above the bottom edge of the inlet orifice 207 of water chamber 206 but below air holes 211 and 243. Initially, water flows through outlet orifice 240 into product chamber 210 until product chamber 210 is filled with water and sanitizer material up to the bottom of the air space 222. The water in the product chamber 210 dissolves some of the sanitizer material to form a sanitizer containing solution. At this time, the water in the discharge 218 is in direct contact with the solution in the product chamber 210. The water in water chamber 206 is isolated from the product chamber 210 by the valve 208 which is sealed by the water pressure in the toilet tank as in the previously described embodiments of the invention. When the toilet is first flushed, the tank water level drops below valve 208 and the water in chamber 206 falls into product chamber 210 displacing an equal volume of solution from product chamber 210 into the tank water via discharge conduits 232 and 230 and discharge orifice 240.

As the tank water level rises above valve 208, closing the valve and sealing the top of the product chamber 210, tank water simultaneously attempts to flow upward through the discharge orifice 240. However, as is described in greater detail below, the air already in the discharge 218 is prevented from venting by the now full product chamber 210 and thus prevents water entering the discharge orifice 240 from reaching the product chamber 210.

Thus, when the level of the water in the tank has reached its upper level where it remains until the next flush of the toilet, the sanitizer material and solution in product chamber 210 are completely isolated from the toilet tank water by the air in discharge 218 and by the sealed valve 208. The cycle described above repeats itself each time the toilet tank is flushed.

During the quiescent periods between flushes, a compressed air bubble or space 260 in discharge conduits 230 and 232 is held in equilibrium and thereby prevents contact between the tank water in discharge conduit 230 at meniscus 262 and solution in conduit portion 234 at meniscus 264 (meniscuses 262 and 264 are illustrated by dotted lines in FIG. 6(*c*)). This equilibrium is maintained because the portion of flexible sheet 204 forming a flexible wall of product chamber 210 transmits the hydrostatic pressure of the tank water to the solution and in fact reduces the internal volume of the product chamber 210 pushing a portion of the solution into air vent 220 to the level of the tank water, so that the hydrostatic pressure of the solution in chamber 210 balances the hydrostatic pressure applied through discharge orifice 240. The hydrostatic pressure of the water is thus prevented from forcing the air bubble into the product chamber, and the air bubble is maintained in an equilibrium position in the discharge conduits 230 and 232.

As the tank water line rises above the discharge orifice 240, water rises in vertical discharge conduit 230 compressing the air thereabove until the level of the water in discharge conduit 230 is substantially the same as the level of the solution in discharge conduit portion 234.

Immediately following the discharge of a volume of solution from the product chamber 210, some solution will fill at least some of the discharge conduit portion 234. As the water level in the tank rises covering the flexible wall portion of the product chamber 210, hydrostatic pressure applied thereto by the tank water urges the level of the water in discharge conduit portion 234 upward, but this is counterbalanced by the increased air pressure applied thereto by air bubble 260 which is compressed by the rising water level in discharge conduit 230. By providing the discharge orifice 240 sufficiently high on vertical discharge conduit 230, the air trapped above the discharge orifice 240 can be compressed into the upper reaches of discharge conduit 230 and discharge conduit 232 above the meniscus of the solution in discharge conduit portion 234. If the discharge orifice 240 were too low, some of the air in vertical discharge conduit 230 would be pushed into the product chamber 210 and out air vent 220 before a stable air bubble were formed in discharge conduits 230 and 232.

In order to assure that a uniform amount of solution is discharged on each and every flush of the toilet, it is desirable that syphoning of solution through discharge conduit 232 at the end of each discharge be avoided. It has been found that syphoning can occur if the discharge orifice 240 is insufficiently large and insufficiently vertically high so that air cannot flow upward through the discharge conduit 230 during the discharge of solution. Such air flow is necessary to fill any vacuum which might otherwise form in discharge conduit 230 and discharge conduit 232 and which would cause some syphoning at the end of the discharge. To prevent syphoning, discharge orifice 240 should be larger than the internal horizontal cross-sectional area of discharge conduit 232.

Also, it has been found that syphoning action is further prevented if the bottom edge 266 of the uppermost portion of discharge conduit 232, i.e., horizontal discharge portion 236, is significantly above the top edge 268 of product chamber 210.

Figure 7:
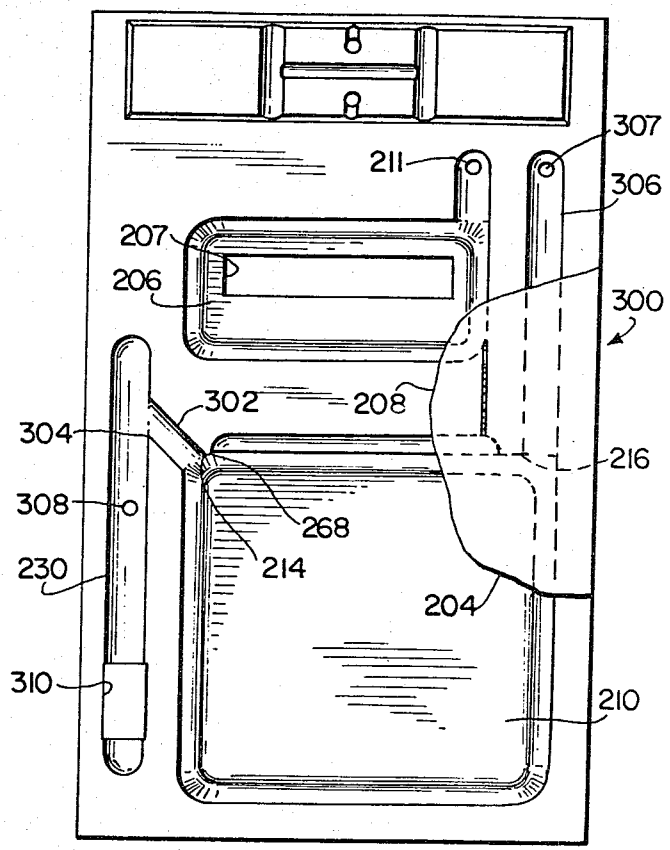
FIG. 7 is a partially torn away rear elevational view of a sixth embodiment of the sanitizer dosing dispenser in accordance with the present invention.
Figure 6D:
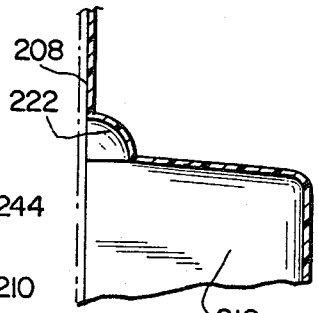
Figure 6C:
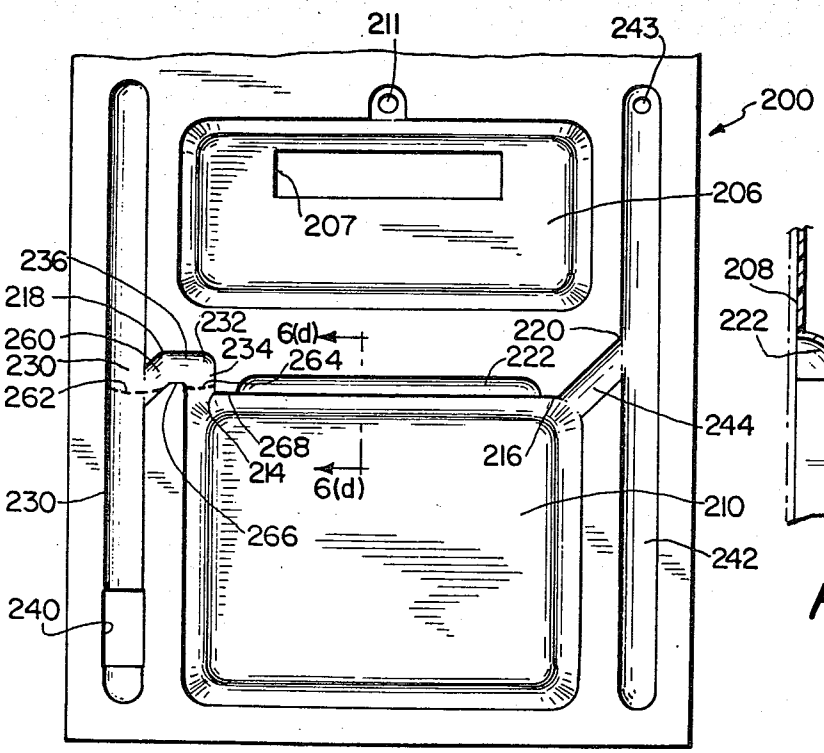

Another embodiment of the invention, which reduces the width of a dispenser of the same general type illustrated in FIGS. 6(*a*)–6(*d*), is illustrated in FIG. 7. In the reduced width embodiment, the discharge conduit connecting the product chamber 210 to the vertical discharge conduit 230, is angled upward in the same manner as the angled portion 244 of the air vent 220 illustrated in FIG. 6(*c*), the width of the water chamber is reduced and the air vent is formed to extend vertically upward from one upper corner of the product chamber.

Referring to FIG. 7, wherein identical or substantially identical elements as those illustrated in FIGS. 6(*a*)–6(*d*) are designated with like numerals, a sanitizer dosing dispenser 300 includes a discharge conduit 302 which angles upward from the left corner 214 of product chamber 210 to vertical discharge conduit 230. The bottom point 304 of intersection between the walls of discharge conduit 302 and discharge conduit 230 is positioned above the top edge 268 of the product chamber 210. Air vent 306 extends directly vertically upward from the right corner 216 of product chamber 210 to a vent orifice 307 above the water chamber 206. In this embodiment of the invention, in order to further obviate the likelihood of syphoning and assure the smooth operation of the dispenser, a small air hole 308 is provided in discharge conduit 230 below intersection 304 and a larger rectangular solution discharge orifice 310 is provided below air hole 308. In other respects, dispenser 300 is substantially identical to dispenser 200 illustrated in FIGS. 6(*a*)–6(*d*).

Figure 8:
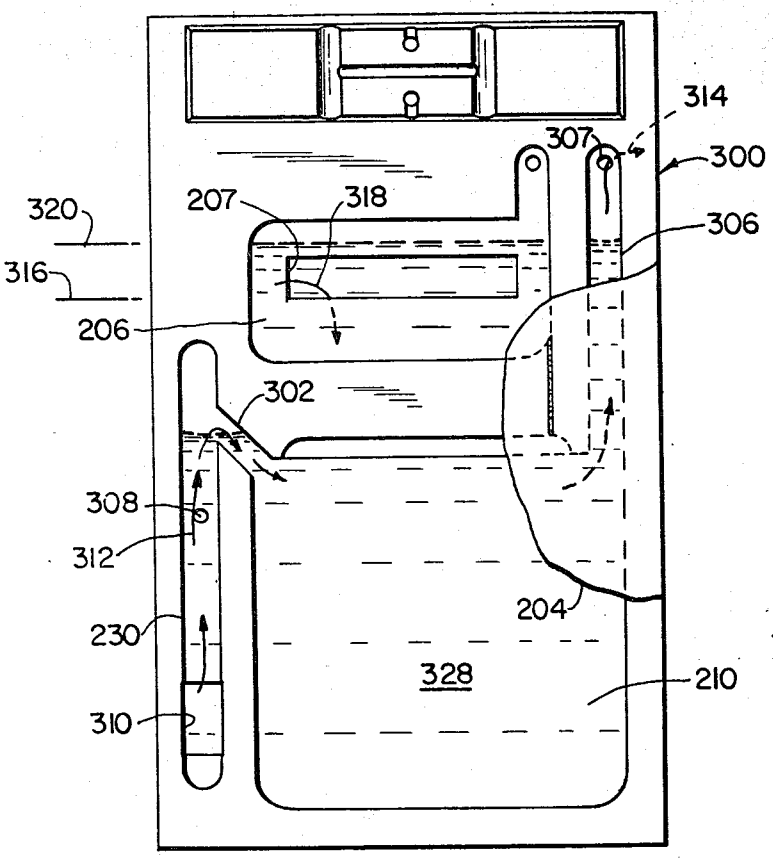

The operation of this embodiment may now be described with reference to FIGS. 8–10. Referring to FIG. 8, in operation, when the bottom end of dispenser 300 is moved below the tank water line, tank water flows through orifice 310 along path 312 into product chamber 210. Air is vented from the product chamber 210 along flow line 314 through air vent 306. The water in the product chamber 210 dissolves some of the sanitizer material therein so as to become saturated therewith. As in the embodiment of the invention illustrated in FIGS. 6(*a*)–6(*d*), the solution designated here by the numeral 328 fills the product chamber up to its upper edge 268. As the dispenser is further lowered into the tank, and the tank water line reaches the level indicated by line 316, tank water flows into the water chamber 206 along the flow path indicated by arrow 318. Referring to FIG. 8, when the tank water line reaches the line designated 320, the now filled dispenser 300 may be positioned for operation along a sidewall of the toilet tank with the tank water line at level 320. As in the operation of the embodiment illustrated in FIGS. 6(*a*)–6(*d*), valve 208 is sealed closed by the hydrostatic pressure of the tank water while the tank water line is above the valve.

Figure 9:
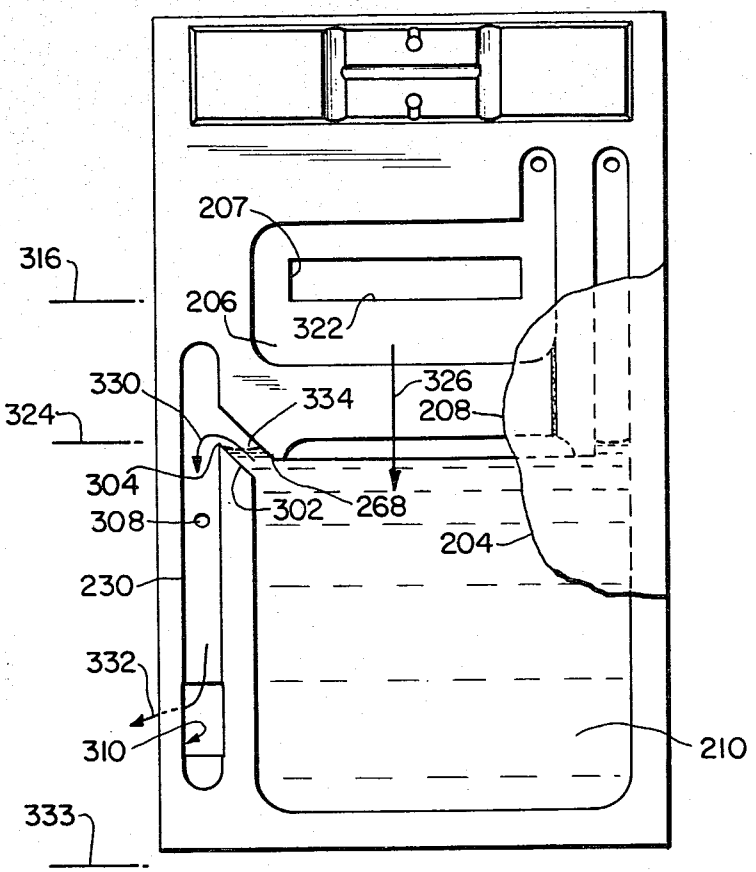
FIGS. 8–10 are sequential partially torn away views showing portions of a cycle of the operation of the embodiment illustrated in FIG. 7.

Referring now to FIG. 9, which illustrates the dispenser during the first toilet flush, when the tank water line recedes to level 316, the water filling the water chamber 206 above the weir 322 (formed by the bottom edge of the water chamber orifice 207) flows back into the toilet tank. As the tank water line drops further to the level marked by the line 324 which is aligned with the bottom edge of the valve 208, valve 208 opens and water trapped in water chamber 206 below weir 322 flows into the product chamber along the flow path marked by arrow 326.

The volume of tank water which falls into the product chamber 210 upon opening of valve 208 displaces an equal volume of solution which is forced along the path marked by arrow 330 through discharge conduit 302 into and through discharge conduit 230 and into the tank water through discharge orifice 310 along the path marked by arrow 332, the tank water line having by this time already fallen to the level designated by the numeral 333 below the dispenser 300. If the toilet is of conventional design, the tank water line will fall below the dispenser 300 before any of the solution has been displaced from the product chamber 210 into the tank water and the displaced solution will be substantially completely dispensed before the tank water line has risen during the refill portion of the flush cycle to the bottom of the dispenser 300. While solution is discharging through discharge orifice 310, some air is permitted to flow back through air hole 308 and discharge orifice 310 so as to prevent a vacuum from forming in the discharge conduits 230 and 302 which could lead to syphoning.

During the interim time between when the volume of solution has been completely dispensed and when the tank water line has risen to the discharge orifice 310, the solution within the dispenser 300 will form a meniscus 334 in the angular discharge conduit 302 at a level below intersection 304 but above the top edge 268 of the product chamber 210, as illustrated in dotted line in FIG. 9.

Figure 10:
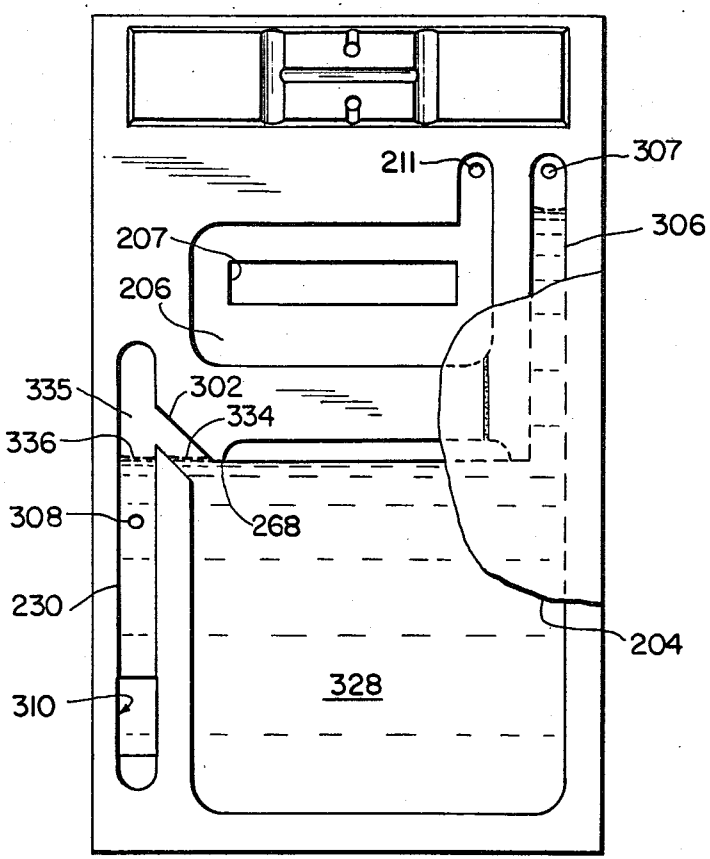

Referring to FIG. 10, when the tank water line again rises above discharge orifice 310, water flows upward in discharge conduit 230, but as opposed to the same event in the operation of the embodiment illustrated in FIGS. 6(*a*)–6(*d*), the rising water in discharge conduit 230 displaces air thereabove through air hole 308 until the level of the tank water reaches above the air hole 308. The remaining air 335 in the discharge conduits 230 and 302 is compressed against the meniscus 334 in the angular discharge conduit 302, pushing the meniscus slightly lower therein but still above the upper edge 268 of product chamber 210. A meniscus is also formed at the air/water interface 336 in the discharge conduit 230 at a vertical level substantially the same as that of meniscus 334. As in the case of the embodiment illustrated in FIGS. 6 (*a*)–6(*d*), the hydrostatic pressure applied through the flexible wall 204 to the solution 328 in product chamber 210 causes the level of the solution 328 to rise in air vent 306 to the level of the tank water as the latter reaches its highest point when the toilet tank becomes full at the end of the flush cycle. In this condition, the hydrostatic pressure in the solution is everywhere in equilibrium with that in the tank water and in the water in discharge conduit 230. Thus, the level of the solution meniscus 334 and the water meniscus 336 are the same and are separated by the volume of air or air bubble 335 in the upper portions of discharge conduits 230 and 302.

Also, as the tank water line rises above valve 208, the valve 208 closes as described with respect to the embodiments of the invention described above and water refills the water chamber 206 as it reaches the upper level 320 when the flush cycle has been completed. Since the valve 208 is closed by the hydrostatic pressure of the tank water to isolate the solution 328 from the water chamber 206, the solution 328 is completely isolated and protected from the tank water until the next flush cycle.

The present invention is particularly suitable for dispensing two or more additives to the toilet water where it is desired to isolate the two additives from each other during quiescent periods between flushes. The desirability of so isolating the additives, such as where one of the additives is an oxidant-type disinfectant, and another additive is a dye or surfactant, is described in U.S. Pat. No. 4,171,546 issued to Dirksing on Oct. 23, 1979, and U.S. Pat. No. 4,216,027, issued to Wages on Aug. 5, 1980. A dual dispenser apparatus of this type in accordance with the present invention can be in the form of any two dispenser units of the type illustrated in any of FIGS. 1(*a*)–7, formed as a unitary device with the dispenser units formed side-by-side. Such a dispenser apparatus in which two identical dispensers with a functional structure identical to the embodiment of the invention shown in FIG. 7, is illustrated in FIG. 11(*a*). Each dispenser unit completely isolates the dye, surfactant, or oxidant type disinfectant in each product chamber from the other and from the tank water during quiescent periods, and discharges a suitable volume of the same during each flush.

Referring to FIG. 11(*a*), a dual dispenser apparatus 400 includes two individual dispenser units 402 and 402', which are internally completely isolated from each other. Dual dispenser apparatus 400 can be mounted to a sidewall of the toilet tank by a holder 406 fastened to the dispenser between the individual dispenser units 402 and 402' as is illustrated in FIGS. 11(*a*) and 11(*b*). Alternatively, as is illustrated in FIG. 12, the dual dispenser apparatus may be provided with a single water chamber unit 410 separated into two compartments 412 and 412' by a central wall 416 which extends from the base 418 of water chamber unit 410 to above the bottom edges (weirs) 420 and 420' of the water orifices 422 and 422' opening into the respective water compartments 412 and 412'.

Figure 13:
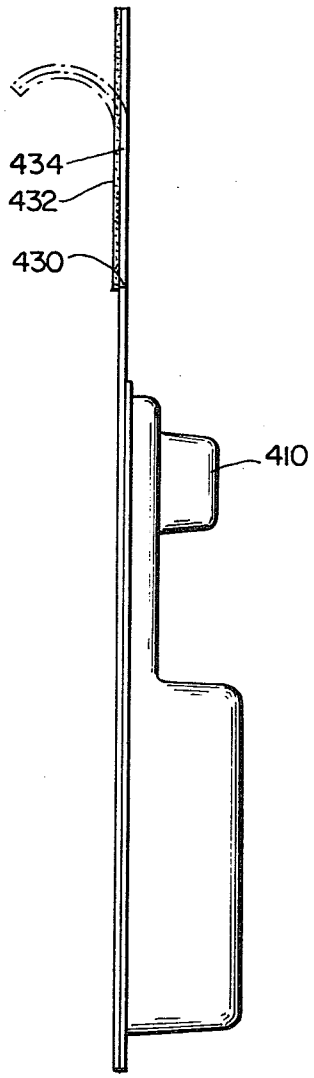
FIG. 13 is a side elevational view of the embodiment of the illustrated in FIG. 12.
Figure 12:
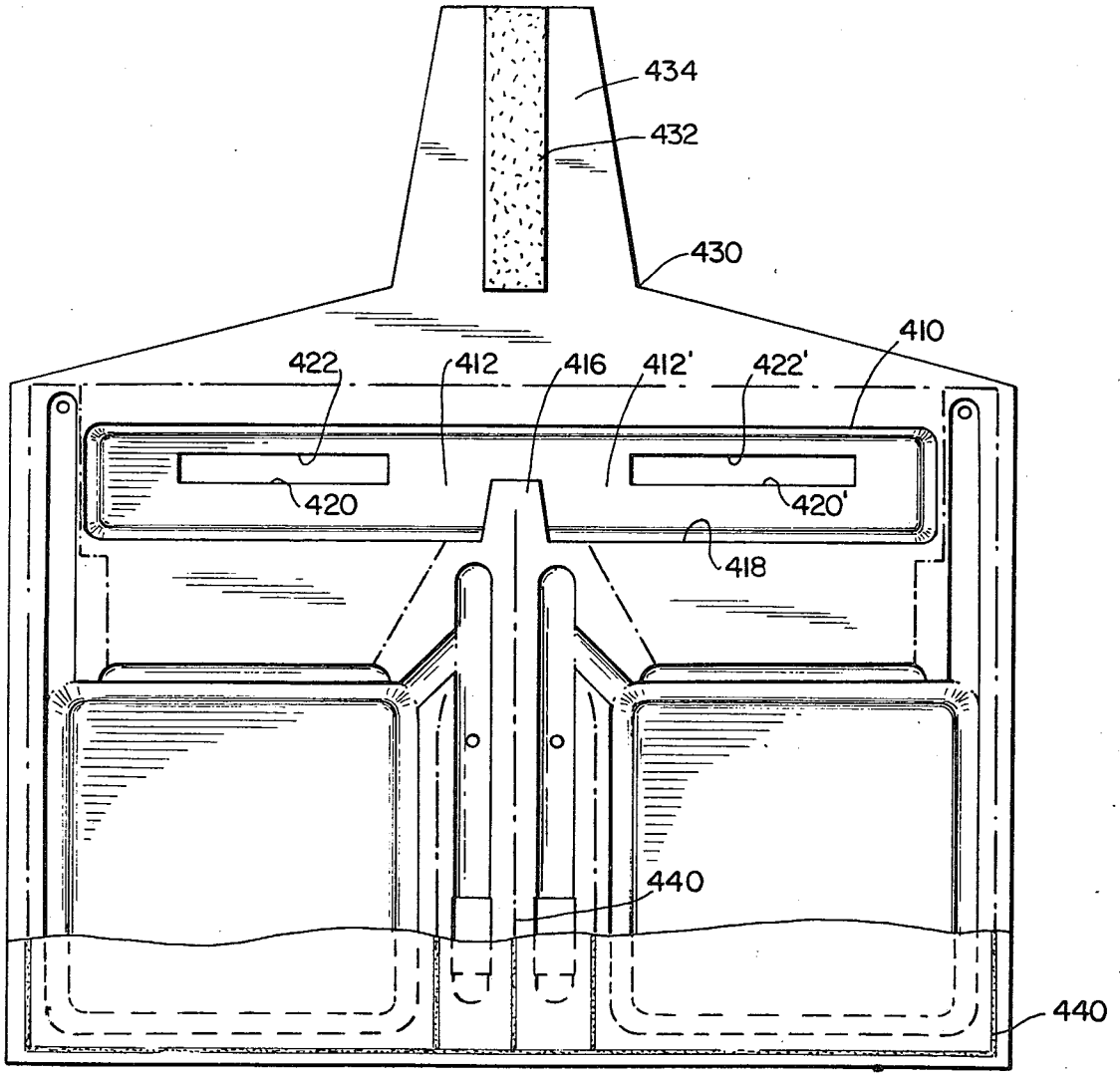
FIG. 12 is a partially torn away rear elevation view of an eighth embodiment of the sanitizer dosing dispenser in accordance with the present invention.

In order to fasten a dual dispenser apparatus having a water chamber unit of the kind illustrated in FIG. 12, holder fastening structure such as illustrated in FIG. 6(*a*) may be utilized. Alternatively, as illustrated in FIG. 12 and FIG. 13, the dispenser apparatus can be provided with a flexible sheet member 430 which extends above the water chamber unit and has a pressure sensitive adhesive 432 on its upper face 434 so that the upper face 434 can be bent as illustrated in FIG. 13 over the top edge of the toilet tank to fasten the dispenser thereto. Such a fastening structure could, of course, also be utilized with a single unit type dispenser of the present invention.

In each of the dual dispenser embodiments, a single wide flexible sheet may be heat sealed at appropriate seal lines to a single unitary rigid molded member to form the dispenser structure as is illustrated, for example, in FIG. 12, the seal lines being designated by the numeral 440.

Figures 11A, 11B, 11C, 14:
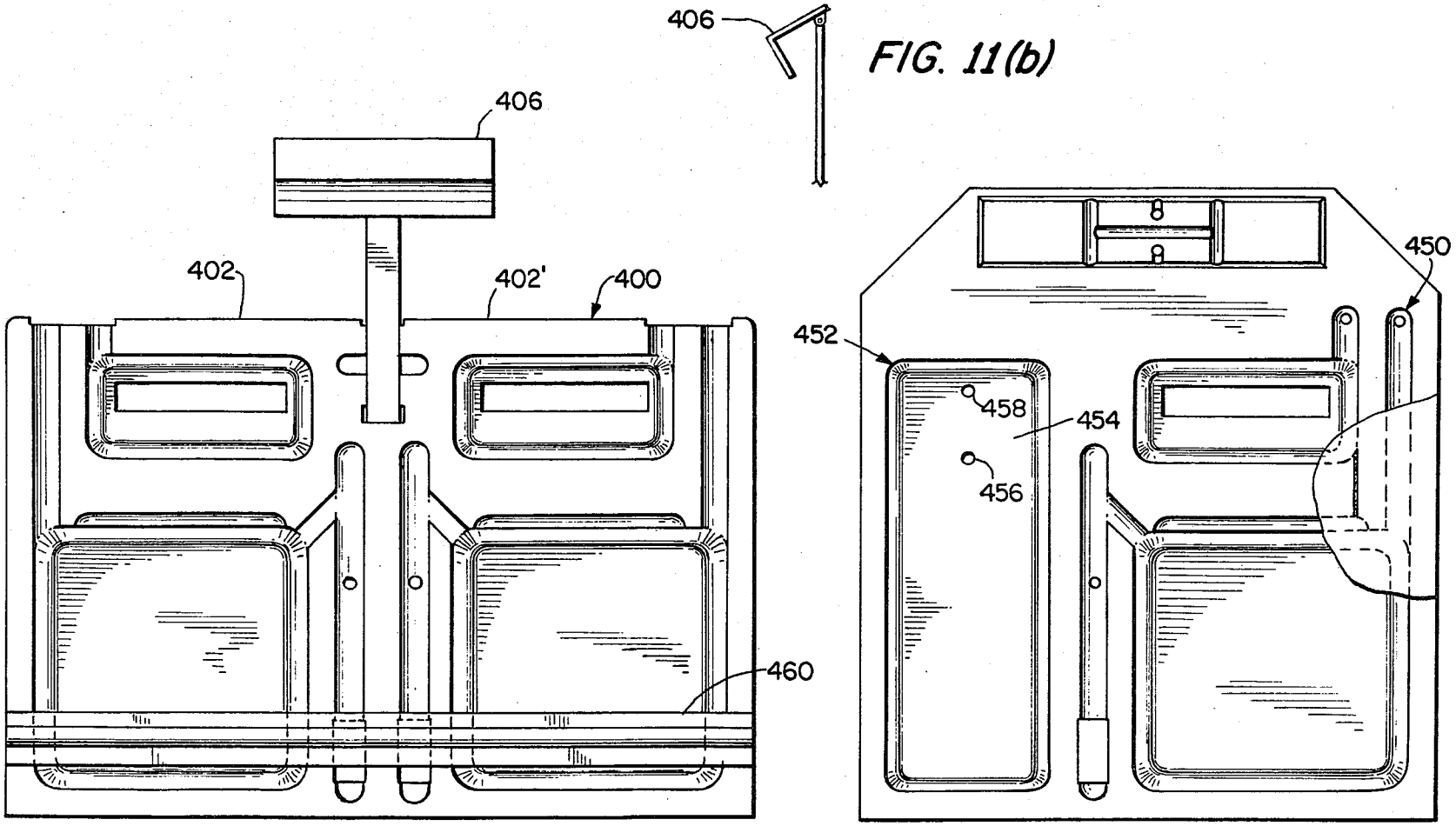
FIG. 14 is a partially torn away rear elevational view of a ninth embodiment of the sanitizer dosing dispenser in accordance with the present invention.

In order to reduce the size of a dual dispenser, and particularly where it is not necessary to maintain isolation between one of the sanitizer products and the tank water during quiescent periods between toilet flushes, the embodiment illustrated in FIG. 14 can be utilized. Referring to FIG. 14, there is illustrated a dispenser unit 450 of the type illustrated in FIG. 7 molded into an integral structure with a dispenser unit 452 of a nonisolating type. Dispenser unit 452 consists simply of a cavity 454 for containing an additive material, provided with holes 456 and 458 which are intended to be respectively below and above the tank water level when the dispenser is mounted in the toilet tank. Thus, a quantity of solution whose volume is defined by the height of hole 456 relative to the water level in the tank, is dispensed to the toilet tank each time the toilet is flushed, the additive material in the cavity 454 being continuously immersed in an additive containing aqueous solution whose level varies between hole 456, and the water line of the tank water when the tank is full.

During tests of the various embodiments of the invention disclosed in the present application, it was discovered that the flexible plastic sheet material became distorted over a period of time due to the pressures applied thereto by the tank water and solution within the product chamber. This led to introduction of creep to the valve between the water chamber and the product chamber, such that the valve did not seal properly. It was found that providing an elongated rigid member such as the U-shaped channel member 460 illustrated in FIG. 11(*a*) and 11(*c*), constructed of the same PVC material as the rigid molded member utilized in the preferred embodiments of the invention, and heat sealed horizontally across the flexible sheet across the product chamber, the above-described problem of creep was eliminated.

Another method of eliminating creep would be the use of a laminated flexible sheet in which the stretch properties of the layers of the laminate differ.

While particular embodiments of the present invention have been illustrated and described, it will be obvious to those skilled in the art that various changes and modifications can be made without departing from the spirit and scope of the invention. The appended claims are intended to cover all such modifications within the scope of the invention. For example, while dispensers in accordance with the preferred embodiments of the invention are designed to completely isolate the contents of the product chamber from the water in which the dispenser is immersed between flushes, other embodiments in which the contents of the product chamber are not so isolated are also contemplated. Furthermore, while the present invention has been described in the context of dispensing a toilet tank additive, it is not intended to thereby limit the present invention.

What is claimed is:

1. A dosing dispenser for immersion in a body of water whose level can be lowered from an upper level to a lower level, comprising:

(a) means for containing a solid, water soluble material;

(b) means, including first and second walls defining a first flow path therebetween, for providing a dose-volume of water from the body of water to said containing means, along said first flow path, in response the level of the body of water in which said dosing dispenser is immersed falling from the upper level to the lower level, said first wall being flexible and located so that hydrostatic pressure from the body of water presses said first wall against said second wall to close said first flow path against water flow therealong when the level of the body of water is above said first wall and permits said dose-volume of water to flow between said first and second walls into said containing means when the level of the body of water is below said first wall, water in said containing means dissolving a portion of said material therein to form a material containing solution; and (c) means for dispensing a dose-volume of the solution from said containing means into the body of water when the body of water falls from the upper level to the lower level.

2. A dosing dispenser as in claim 1, wherein said means for providing a dose-volume of water comprises a water chamber in fluid communication with the exterior of said dispenser for holding a dose-volume of water above said first flow path when the body of water is at the upper level, the dose-volume of water falling by gravity along said first flow path into said containing means from said water chamber when the level of the body of water falls below said first wall.

3. A dosing dispenser as in claim 2 further comprising means for varying the volume of the dose-volume of water.

4. A dosing dispenser as in claim 3, wherein said volume varying means comprises means for varying the height of said dispenser in the body of water relative to the upper level, and an orifice into said water chamber for receiving water therein when the level of the body of water is at the upper level and for returning a portion of the water in said water chamber to the body of water exterior of said dispenser, the size of said orifice being sufficiently small that the rate at which the level of water in the water chamber falls when the level of the body of water falls is substantially slower than the rate at which the level of the body of water falls.

5. A dosing dispenser as in claim 1, further comprising means for isolating the solid, water soluble material in said containing means from fluid communication with the body of water.

6. A dosing dispenser as in claim 5, wherein said isolating means includes means for providing a dose-volume of the solution from said containing means to the body of water along a second flow path in response to the body of water falling from the upper level to the lower level, said means for providing a dose-volume of the solution including means for forming an air bubble therein isolating the solid material from the body of water while the body of water is at the upper level.

7. A dosing dispenser as in claim 5, wherein said isolating means comprises means, including third and fourth walls defining a second flow path therebetween, for providing a dose-volume of solution from said containing means to the body of water along said second flow path in response to the level of the body of water falling from the upper level to the lower level, said third wall being flexible and located so that hydrostatic pressure applied by the body of water presses said third wall against said fourth wall to close said second flow path against water flow therealong when the level of the body of water is above said third wall and permits the dose-volume of solution to flow from said containing means between said third and fourth walls to the exterior of said dispenser into the body of water when the level of the body of water falls below said third wall.

8. A dosing dispenser as in claim 7, wherein said third and fourth walls are respectively located below said first and second walls in vertical spaced relation thereto.

9. A dosing dispenser as in claim 7, wherein said containing means comprises a flexible fifth wall integral with said first wall and said third wall, and a sixth wall integral with said second and fourth walls, said second, fourth and sixth walls forming a shaped integral member having first and second side edges, said first, third and fifth walls forming a first integral flexible sheet having third and fourth side edges respectively sealed to said first and second side edges of said shaped integral member at said first, third and fifth walls.

10. A dosing dispenser as in claim 9, wherein said sixth wall opposes said fifth wall and is so shaped as to define a chamber between said fifth and sixth walls for holding the solid material, and for holding said solution only when the level of the body of water is falling and is above said third wall and below said first wall.

11. A dosing dispenser as in claim 9, further comprising means for preventing permanent deformation of said first flexible sheet in response to hydrostatic pressure applied thereto by the body of water.

12. A dosing dispenser as in claim 11, wherein said flexible sheet is formed of plastic.

13. A dosing dispenser as in claim 11, wherein said deformation preventing means comprises a rigid member fixed to said flexible sheet, extending between said third and fourth side edges.

14. A dosing dispenser as in claim 13, wherein said rigid member and said flexible sheet are formed of plastic.

15. A dosing dispenser as in claim 11, wherein said deformation preventing means comprises a second flexible sheet adhered to said first flexible sheet and having different deformation properties than those of said first flexible sheet.

16. A dosing dispenser as in claim 2, wherein said containing means comprises a flexible fifth wall integral with said first wall and a sixth wall integral with said second wall, and said water chamber comprises a flexible seventh wall integral with said first wall and an eighth wall integral with said second wall, said second, sixth and eighth walls forming a shaped integral member having first and second side edges, said first, fifth and seventh walls forming an integral flexible sheet having third and fourth side edges respectively sealed to said first and second side edges of said shaped integral member at said first, fifth and seventh walls, said seventh wall including a bendable upper portion extending above said eighth wall, said upper portion having a pressure sensitive adhesive backing for adhering said dispenser to the rim of a toilet tank when said upper portion is bent thereabout.

17. A dosing dispenser as in claim 7, wherein said means for providing a dose-volume of water comprises a water chamber in fluid communication with the exterior of said dispenser for holding a dose-volume of water above said first flow path when the body of water is at the upper level, the dose-volume of water falling by gravity along said first flow path into said containing means from said water chamber when the level of the body of water falls below said first wall.

18. A dosing dispenser as in claim 17, wherein said water chamber comprises seventh and eighth walls respectively integral with said first and second walls, one of said seventh and eighth walls having an orifice therein vertically spaced from said first and second walls opening into said water chamber.

19. A dosing dispenser as in claim 17, wherein said water chamber comprises a molded member, said molded member including first sidewalls having an upper opening and a lower opening below said upper opening, and a first bottom wall, said water chamber communicating with the exterior of said dispenser through said upper opening; said containing means comprising a molded product chamber having second sidewalls and a second bottom wall, said second sidewalls having a first product chamber opening, vertically aligned with said lower opening of said first sidewalls in vertical spaced relation thereto, said first and second sidewalls having portions thereof between said lower opening and said first product chamber opening, said portions forming said second wall, said first wall covering said lower opening, said second wall and said product chamber opening; said first flow path extending from said water chamber through said lower opening, between said first and second walls, through said first product chamber opening and into said product chamber.

20. A dosing dispenser as in claim 7, wherein said containing means includes a product chamber having a top end, for containing the material and the material containing solution; said product chamber being in fluid communication with said first flow path when the level of the body of water is below said first wall, said means for providing a dose-volume of solution including means, responsive to entry of the dose-volume of water into said product chamber through said first flow path, for transmitting the dose-volume of solution, displaced by the dose-volume of water, from said product chamber to said second flow path.

21. A dosing dispenser as in claim 20, wherein said means for providing a dose-volume of water comprises a water chamber in fluid communication with the exterior of said dispenser for holding a dose-volume of water above said first flow path when the body of water is at the upper level, said dose-volume of water falling by gravity along said first flow path into said containing means from said water chamber when the level of the body of water falls below said first wall.

22. A dosing dispenser as in claim 20, wherein said transmitting means includes a conduit for providing fluid communication between said top end of said product chamber and said second flow path, whereby providing the dose-volume of water into said product chamber displaces the dose-volume of solution from said product chamber into said conduit, the dose-volume of solution flowing by gravity from said conduit to the exterior of said dispenser between said third and fourth walls when the level of the body of water falls below said third wall.

23. A dosing dispenser as in claim 22, wherein said means for providing a dose-volume of water comprises a water chamber in fluid communication with the exterior of said dispenser for holding a dose-volume of water above said first flow path when the body of water is at the upper level, the dose-volume of water falling by gravity along said first flow path into said containing means from said water chamber when the level of the body of water falls below said first wall.

24. A dosing dispenser as in claim 23, wherein said water chamber comprises a molded member, said molded member including first sidewalls having an upper opening and a lower opening below the upper opening and a first bottom wall, said water chamber communicating with the exterior of said dispenser through said upper opening, said containing means comprising a molded product chamber having second sidewalls and a second bottom wall, said second sidewalls having a first product chamber opening, vertically aligned with said lower opening of said first sidewalls in vertical spaced relation thereto; said first and second sidewalls having portions thereof between said lower opening and said first product chamber opening forming said second wall, said first wall covering said lower opening, said second wall and said first product chamber opening, said first flow path extending from said product chamber through said lower opening, between said first and second walls, through said first product chamber opening and into said product chamber.

25. A dosing dispenser as in claim 22, further comprising a dispensing chamber having a discharge orifice in fluid communication with the exterior of said dispenser, for delaying dispensing of the dose-volume of solution into the body of water exterior of said dispenser.

26. A dosing dispenser as in claim 7, further comprising a dispensing chamber having a discharge orifice in fluid communication with the exterior of said dispenser, for delaying the dispensing of the dose-volume of solution into the body of water exterior of said dispenser.

27. A dosing dispenser for immersion in a body of water capable of falling from an upper level to a lower level, comprising:

(a) a first chamber;

(b) a second chamber for containing a solid water soluble material, below said first chamber;

(c) means for trapping a dose-volume of water in said first chamber;

(d) a first normally closed valve means, including a valve located between said first and second chambers, said valve being openable in response to falling of the level of the body of water therepast, for providing the dose-volume of water from said first chamber into said second chamber, water in said second chamber dissolving a portion of the solid material therein to form a solution; and (e) means, normally isolating the solid material from the body of water in which said dispenser is immersed, for providing a dose-volume of solution from said second chamber to the body of water in response to falling of the body of water from the upper level to the lower level.

28. A dosing dispenser as in claim 27, wherein said means for providing a dose-volume of solution comprises second, normally closed, valve means, located beneath said second chamber and responsive to the level of the body of water falling below said second means, for providing the dose-volume of solution from said second chamber to the body of water.

29. A dosing dispenser as in claim 27, wherein said means for providing a dose-volume of solution from said second chamber to the body of water in response to falling of the body of water from the upper level to the lower level includes means for forming an air bubble between said second chamber and the body of water, the air bubble isolating the solid material from the body of water while the body of water is at the upper level.

30. A dosing dispenser, comprising:

(a) reservoir walls surrounding an internal reservoir for containing a solid water soluble material isolated from a body of water in which said dispenser is immersed;

(b) first and second walls defining a first flow path therebetween for providing a dose-volume of water from the body of water to said internal reservoir along said first flow path in response to the level of the body of water falling from an upper level above said first wall to a lower level, said first wall being flexible and having a first face facing said second wall and a second face facing exteriorly of said dispenser so that when said dispenser is immersed in the body of water, hydrostatic pressure from the body of water presses said first wall against said second wall to close said first flow path against water flow therealong when the level of the body of water is above said first wall and permits the dose-volume of water to flow between said first and second walls into said reservoir when the level of the body of water falls below said first wall, water in said reservoir dissolving a portion of the solid material to form a material containing solution; and (c) means for dispensing a dose-volume of the solution from said reservoir into the body of water in response to the body of water falling from the upper level to the lower level.

31. A dosing dispensing as in claim 30, wherein said dispensing means comprises means, including third and fourth walls defining a second flow path therebetween, for providing a dose-volume of the solution from said reservoir to the body of water along said second flow path in response to the body of water falling from the upper level to the lower level, the third wall being flexible and having a first surface facing said fourth wall and a second surface facing exteriorly of said dispenser so that when said dispenser is immersed in the body of water, hydrostatic pressure from the body of water is applied to said second surface so as to press said first surface against said fourth wall to close said second flow path against water flow therealong when the level of the body of water is above said third wall and permits the dose-volume of solution to flow from said reservoir between said third and fourth walls into the body of water when the level of the body of water falls below said third wall.

32. A dispenser as in claim 30, wherein said dispensing means and said reservoir walls are so formed that the dose-volume of solution is displaced from said reservoir into the body of water in response to entry of the dose-volume of water into said reservoir along said first flow path.

33. A dosing dispenser as in claim 32, wherein said dispensing means comprises means for transmitting from said reservoir a dose-volume of solution, substantially equal in volume to the volume of, and displaced by, the dose-volume of water, and causing the dose-volume of solution to issue from said dispenser, said transmitting means including a solution discharge having a first end opening into the vertically substantially topmost end of said reservoir and having a vertically extending first conduit communicating with said first end, said first conduit having a second end provided with a discharge orifice opening externally of said dispenser, said discharge orifice opening into the body of water when said dispenser is immersed in the body of water, such that the dose-volume of solution is displaced from said reservoir via said solution discharge and through said discharge orifice, said dispensing means including means for forming a bubble of air therein which isolates the solution in the reservoir from the body of water when the level of the body of water is at the upper level.

34. A dosing dispenser as in claim 33, wherein said transmitting means comprises an air vent spaced from said first conduit opening said topmost end of said reservoir to the atmosphere above the upper level.

35. A dosing dispenser as in claim 34, wherein said means for forming an air bubble comprises a flexible boundary wall having a first surface forming a boundary of said internal reservoir and a second surface facing externally of said dispenser so as to be immersed in the body of water when said dispenser is immersed in the body of water, said flexible boundary wall being sufficiently large and having sufficient flexibility that when the level of the body of water is above said first flow path, the hydrostatic pressure of the body of water at said second surface is transmitted to the solution in said internal reservoir such that at equal distances below the level of the body of water the hydrostatic pressures in said internal reservoir and in the body of water are the same, whereby the hydrostatic pressures in the body of water and the solution are equal at opposite ends of the bubble.

36. A dosing dispenser as in claim 33, wherein said discharge orifice has a cross-sectional area greater than the internal cross-sectional area of said first conduit, said solution discharge comprising means, including said discharge orifice, for permitting air to flow through said discharge orifice into said first conduit while the dose-volume of solution is issuing through said discharge orifice and the level of the body of water is below said discharge orifice, thereby preventing any of the solution to be drawn by suction from said reservoir when the level of the body of water falls from the upper level to the lower level.

37. A dosing dispenser as in claim 36, wherein said discharge orifice includes a first opening positioned in said first conduit such that the dose-volume of solution issues through said first opening when the body of water falls from the upper level to the lower level, an amount of water flowing upward into said first conduit through said discharge orifice when the level of the body of water rises from the lower level to above said discharge orifice, said discharge orifice also including a second opening smaller than said first opening above said first opening so that when the amount of water flows into said first conduit through said first opening, air in said solution discharge is displaced through said second opening until the level of the body of water covers the second opening, the air remaining in the solution discharge forming the bubble between the amount of water and the solution in said reservoir.

38. A dosing dispenser as in claim 33, wherein said solution discharge includes a second conduit extending from said first end to said first conduit and opening into said first conduit at its intersection therewith, said second conduit having a generally inverted U-shape portion, the vertically topmost portion of said generally inverted U-shape portion extending above said topmost end of said reservoir, said means for forming a bubble including means for providing the bubble in said topmost portion of said generally inverted U-shape portion when the body of water is at the upper level.

39. A dosing dispenser as in claim 33, wherein said solution discharge includes a second conduit extending obliquely upward from said first end to said first conduit and opening into said first conduit at its intersection therewith, said intersection being entirely above said topmost end of said reservoir, said means for forming a bubble of air including means for providing the bubble at said intersection when the body of water is at the upper level.

40. A dosing dispenser comprising:

(a) first outer walls surrounding an internal reservoir for containing a solution isolated from a body of liquid in which said dispenser is immersed;

(b) first transmitting means, located above said reservoir, for transmitting a predetermined dose-volume of said liquid into said reservoir; and (c) second transmitting means for transmitting a dose-volume of solution substantially equal in volume to the dose-volume of liquid, from said reservoir and causing the dose-volume of solution to issue from said dispenser, in response to the level of the body of liquid being lowered from an upper level to a lower level;

(d) said first transmitting means including:

(1) second outer walls surrounding a cavity for holding the dose-volume of liquid above said reservoir said first transmitting means defining a passage connecting said reservoir and said cavity, and (2) a first flexible member located between said upper level and said lower level when said dispenser is immersed in the body of liquid so as to be covered by the body of liquid when the body of liquid is at the upper level and uncovered by the body of liquid when the body of liquid is lowered from the upper level to the lower level, such that said first flexible member closes said passage so as to block the dose-volume of liquid from flowing therethrough from said cavity into said reservoir in response to hydrostatic pressure applied thereto by the body of liquid when the body of liquid is at the upper level, said first flexible member opening said passage so that the dose-volume of liquid flows therethrough from said cavity into said reservoir, when the level of the body of liquid is lowered from the upper level to the lower level.

41. A dosing dispenser as in claim 40, wherein said first transmitting means includes a connecting wall connecting said first outer walls and said second outer walls, said first flexible member being disposed in confronting relation to a portion of said connecting wall with said passage defined therebetween such that said first flexible member is pressed against said connecting wall to close said passage in response to hydrostatic pressure applied thereto by the body of liquid when the body of liquid is at the upper level said first flexible member being spaced from said connecting wall when the level of the body of liquid is below said connecting wall and the dose-volume of liquid flows through said passage.

42. A dosing dispenser as in claim 41, wherein said second transmitting means comprises means, located below said reservoir, for isolating the solution in said reservoir from the body of liquid when the level of the body of liquid is above said isolating means; said isolating means comprising a discharge conduit for transmitting the dose-volume of solution from said reservoir to the body of liquid, said discharge conduit having a first end opening into said reservoir at the vertically topmost end of said reservoir, and a second end opening externally of said dispenser and into the body of liquid in which said dispenser is immersed, the dose-volume of solution issuing through said second end of said discharge conduit, said discharge conduit being so shaped that a space free of any of the liquid and any of the solution is formed in said discharge conduit, which free space isolates the solution in said reservoir from the body of liquid when the body of liquid is raised from the lower level to the upper level.

43. A dosing dispenser for immersion in a body of water the level of which can be lowered from an upper level to a lower level, comprising:

a water chamber, in fluid communication with the body of water in which the dispenser is immersed, for holding a predetermined volume of water;

a product chamber, below said water chamber, for holding a water soluble product;

first means, entirely located between said water chamber and said product chamber and directly exposed to the body of water, for transmitting the predetermined volume of water from said water chamber into said product chamber along a first flow path to dissolve a portion of said product into a solution in response to the body of water falling from the upper level to immediately below said first means, said first means blocking said first flow path in response to the hydrostatic pressure of the water to which said first means is exposed when the level of the body of water is above said first means;

and means for dispensing a dose-volume of the solution from said product chamber into the body of water along a second flow path separated from said first flow path, when the body of water falls from the upper level to the lower level, the dose-volume of solution having substantially the same volume as the predetermined volume of water.

44. A dosing dispenser as in claim 43, wherein said dispensing means and said product chamber are so formed that the dose-volume of solution is displaced from said product chamber into the body of water by the predetermined volume of water when the body of water is lowered from the upper level to the lower level.

45. A dosing dispenser as in claim 44, wherein said dispensing means includes means, responsive to the body of water being raised from the lower level to the upper level, for forming a stationary air bubble in the second flow path so as to block liquid communication between said product chamber and the body of water when the body of water is at the upper level.

46. A dosing dispenser as in claim 43, wherein said second flow path is located below said product chamber, said dispensing means comprising second means, located entirely below said product chamber and directly exposed to the body of water, for blocking said second flow path in response to the hydrostatic pressure of the water to which said second means is exposed when the level of the body of water is above said second means, as to hold the dose-volume of solution in said product chamber until the level of the body of water falls below said second means, the dose-volume of solution falling by gravity into the body of water along said second path when said the level of the body of water falls below said second means.

47. A dosing dispenser for simultaneously dispensing two different solutions, comprising:

first and second dispenser units fixed together, each of said first and second units including:

(a) reservoir walls surrounding an internal reservoir for containing a solid water soluble material isolated from a body of water in which said dispenser is immersed, the interior of the internal reservoirs of said first and second units being isolated from fluid communication with each other;

(b) first and second walls defining a first flow path therebetween for providing a dose-volume of water from said body of water to said internal reservoir along said first flow path in response to the level of the body of water falling from an upper level above said first wall to a lower level, said first wall being flexible and having a first surface facing said second wall and a second surface facing exteriorly of said dispenser so that when said dispenser is immersed in the body of water, hydrostatic pressure from the body of water is applied to said second surface so as to press said first surface against said second wall to close said first flow path against water flow therealong when the level of the body of water is above said first wall and permits the dose-volume of water to flow between said first and second walls into said reservoir when the level of the body of water falls below said first wall, water in said reservoir dissolving a portion of said material to form a material containing solution; and (c) means for dispensing a dose-volume of the solution from said reservoir into the body of water in response to the body of water falling from the upper level to the lower level.

48. A dosing dispenser as in claim 47, wherein said dispensing means of at least one of said first and second units comprises means, including third and fourth walls defining a second flow path therebetween, for providing a dose-volume of solution from said reservoir to the body of water along said second flow path in response to the body of water falling from the upper level to the lower level, the third wall being flexible and having a first surface facing said fourth wall and a second surface facing exteriorly of said dispenser so that when said dispenser is immersed in the body of water, hydrostatic pressure from the body of water is applied to said second surface so as to press said first surface against said fourth wall to close said second flow path against water flow therealong when the level of the body of water is above the third wall, and permits the dose-volume of solution to flow from said reservoir between said third and fourth walls into the body of water when the level of the body of water falls below the third wall.

49. A dosing dispenser as in claim 47, wherein said dispensing means and said reservoir walls of at least one of said first and second units are so formed that the dose-volume of solution is displaced from said reservoir into the body of water in response to entry of the dose-volume of water into said reservoir along said first flow path.

50. A dosing dispenser as in claim 49, wherein said dispensing means comprises means for transmitting from said reservoir a dose-volume of solution substantially equal in volume to the volume of, and displaced by, the dose-volume of water, and causing the dose-volume of solution to issue from said dispenser; said transmitting means including a solution discharge having a first end opening into the vertically substantially topmost end of said reservoir and having a vertically extending first conduit communicating with said first end and having a second end provided with a discharge orifice opening externally of said dispenser, said discharge orifice opening into the body of water when said dispenser is immersed in the body of water, such that the dose-volume of solution is displaced from said reservoir via said solution discharge and through said discharge orifice, said dispensing means including means for forming a bubble of air therein which isolates the solution in the reservoir from the body of water when the body of water is at the upper level.

51. A dosing dispenser as in claim 50, wherein said transmitting means comprises an air vent spaced from said first conduit portion opening said topmost end of said reservoir to the atmosphere above the upper level.

52. A dosing dispenser as in claim 50, wherein said discharge orifice has a cross-sectional area greater than the internal cross-sectional area of said first conduit, said solution discharge comprising means, including said discharge orifice, for permitting air to flow through said discharge orifice into said first conduit while the dose-volume of solution is issuing through said discharge orifice and the level of the body of water is below said discharge orifice, thereby preventing any of the solution to be drawn by suction from said reservoir when the body of water falls from the upper level to the lower level.

53. A dosing dispenser as in claim 50, wherein said solution discharge includes a second conduit extending angularly upward from said first end to said first conduit and opening into said first conduit at its intersection therewith, said intersection being entirely above the topmost end of said reservoir, said means for forming a bubble including means for providing the bubble at said intersection when the body of water is at the upper level.

* * * * *